United States Patent [19]

Kawaguchi et al.

[11] Patent Number: 4,594,282

[45] Date of Patent: Jun. 10, 1986

[54] LAYER STRUCTURE OF THIN-FILM ELECTROLUMINESCENT DISPLAY PANEL

[75] Inventors: Masashi Kawaguchi, Nara; Kinichi Isaka, Yamatokoriyama; Yoshihiro Endo; Hiroshi Kishishita, both of Nara, all of Japan

[73] Assignee: Sharp Kabushiki Kaisha, Osaka, Japan

[21] Appl. No.: 557,376

[22] Filed: Dec. 1, 1983

Related U.S. Application Data

[63] Continuation of Ser. No. 400,976, Jul. 22, 1982, abandoned.

[30] Foreign Application Priority Data

Jul. 31, 1981 [JP] Japan ..... 56-121004

[51] Int. Cl.[4] ..... H05B 33/12

[52] U.S. Cl. ..... 428/216; 313/509; 428/215; 428/432; 428/690; 428/917

[58] Field of Search ..... 313/509, 506; 428/432, 428/917, 215, 216, 690

[56] References Cited

U.S. PATENT DOCUMENTS

| | | | |
|---|---|---|---|
| 3,007,070 | 10/1961 | Cargill | 313/509 |
| 4,188,565 | 2/1980 | Mizukami | 313/509 |
| 4,287,449 | 1/1981 | Takeda | 313/509 |

FOREIGN PATENT DOCUMENTS 1543233 3/1979 United Kingdom .

*Primary Examiner*—Ellis P. Robinson

*Attorney, Agent, or Firm*—Birch, Stewart, Kolasch & Birch

[57] ABSTRACT

A thin-film electroluminescent (EL) element comprises a thin-film electroluminescent layer, first and second dielectric layers for supporting the element layer, the first dielectric layer being disposed on a smooth surface and the second dielectric layer being disposed on an uneven surface, the thickness of the first dielectric layer being thicker than that of the second dielectric layer such that the dielectric properties of the element are assured, and first and second electrodes provided on the dielectric layers, respectively.

26 Claims, 3 Drawing Figures

LAYER STRUCTURE OF THIN-FILM ELECTROLUMINESCENT DISPLAY PANEL

This application is a continuation of application Ser. No. 400,976, filed on July 22, 1982, now abandoned.

BACKGROUND OF THE INVENTION

The present invention relates to the structure of a thin-film electroluminescent (referred to as "EL" hereinafter) display panel and, more particularly, to a layer structure of a thin-film electroluminescent display panel.

Firstly, a conventional electroluminescent (EL) display panel is illustrated in FIG. 1, wherein the EL display panel comprises a first transparent glass substrate 1, a transparent electrode 2 made of $In_2O_3$, $SnO_2$ etc. formed thereon, a first dielectric layer 3 made of $Y_2O_3$, $TiO_2$, $Si_3N_4$, $SiO_2$, etc., an EL thin film 4 made of ZnS:Mn, and a second dielectric layer 5 made of a similar material of the first dielectric layer 3. A counter electrode 6 is made of Al and is formed on the second dielectric layer 5 through evaporation techniques. The first dielectric layer 3 is provided by sputtering or electron beam evaporation techniques. The EL thin film 4 is made of a ZnS thin film doped with manganese at a desired amount.

An AC electric field from an AC power source 7 is applied to the transparent electrode 2 and the counter electrode 6 to activate the EL thin film 4.

The EL thin film 4 is fabricated by electron beam evaporating a ZnS sintered pellet doped with Mn at a preferable quantity and, then, by heat-treating it in a vacuum or an inert gas atmosphere. Mn serves as a luminescent center in the EL thin film 4. The above EL display panel is characterized in that a conductive current does not flow into the EL thin film 4, but a displacement current flows within the film 4 in the form of the drift of free electrons therein, in order to emit electroluminescence from the film 4. The dielectric properties of the first and the second dielectric layers 3 and 5 surrounding the film 4 are very critical to the reliability of the EL display panel. The dielectric properties are to be able to withstand a high applied voltage.

The dielectric properties of the EL display panel depend on the thickness of the first and the second dielectric layers 3 and 5, in addition to the substances of these layers. To increase the dielectric properties of the layers, it is preferable that the layers are made thick.

However, as the dielectric layers 3 and 5 are made thick, a high operating voltage is needed. FIG. 2 shows a graph representing the relation of electroluminescence brightness VS. applied voltages of the EL display panel, where an $l_1$ curve is related to the thickness of the layers thinner than that of the layers related to an $l_2$ curve. As shown in this graph, the rising of the electroluminescence brightness in response to the increase of the applied voltage is made slower as the thickness of the layers are larger.

This indicates that the total thickness of the first and the second dielectric layers 3 and 5 should be limited to some extent within which the dielectric properties of these layers must be improved.

In addition, the dielectric properties of the dielectric layers 3 and 5 depend greatly on the surface condition, namely, the smoothness of the substrate for supporting the layers. The first dielectric layer 3 is supported on the surface of the transparent electrode 2. The substrate for the second dielectric layer 5 is the surface of the EL thin film 4. Comparing the surfaces of the electrode 2 and the film 4, the surface of the electrode 2 is smoother than that of the film 4.

More particularly, since the electrode 2 is formed on the very smooth surface of the transparent glass substrate 1 in a small thickness, the surface of the electrode 2 is very smooth. On the other hand, the film 4 is formed on a plurality of thin layers so that the surface condition of the film 4 depends on the surface conditions of all these thin layers, in totality. Further, the film 4 comprises a polycrystalline film having large grain sizes in a large thickness, so that the surface of the film 4 is not smooth, but rather rugged due to the condition that a plurality of pin holes which are very uneven are present.

Therefore, in a case where the dielectric layers 3 and 5 are formed with the same manufacture conditions, the dielectric properties of the second dielectric layer 5 are worse than those of the first dielectric layer 3.

In conclusion, the conventional layers are not suitable for the thin-film EL display panel to assure appropriate dielectric properties of the layers.

SUMMARY OF THE INVENTION

Accordingly, it is an object of the present invention to provice an improved thin-film electroluminescence (EL) display panel.

It is another object of the present invention to provide an improved layer structure of a thin-film EL display panel.

It is a further object of the present invention to provide improved layers of a thin-film EL display panel.

Briefly described, in accordance with the present invention, a thin-film electroluminescent (EL) element comprises a thin-film electroluminescent layer, first and second dielectric layers for supporting the element layer, the first dielectric layer being disposed on a smooth surface and the second dielectric layer being disposed on an uneven surface, the thickness of the first dielectric layer being thicker than that of the second dielectric layer such that the dielectric properties of the element are assured, and first and second electrodes provided on the dielectric layers, respectively.

BRIEF DESCRIPTION OF THE DRAWINGS

The present invention will become more fully understood from the detailed description given hereinbelow and accompanying drawings which are given by way of illustration only, and thus are not limitative of the present invention and wherein.

DESCRIPTION OF THE INVENTION

Figure 1:
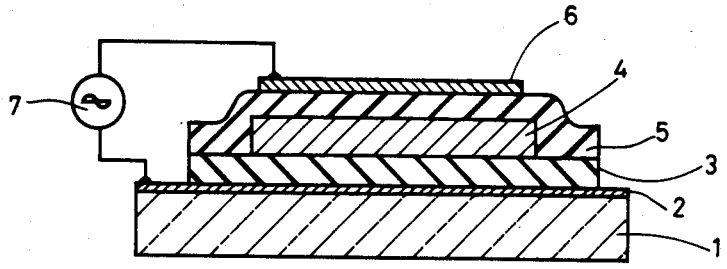
FIG. 1 PRIOR ART
FIG. 1 shows a cross-sectional view of a conventionl thin-film EL display panel.
Figure 2:
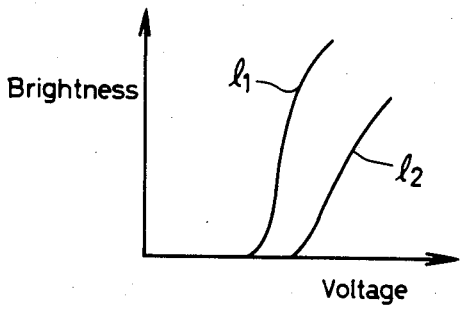
FIG. 2 shows a graph representing the relation of electroluminescence brightness vs. applied voltages of the EL panel as shown in FIG. 1.
Figure 3:
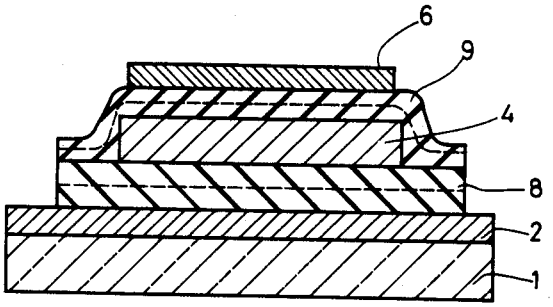
FIG. 3 shows a cross-sectional view of a thin-film EL display panel according to the present invention.

FIG. 3 shows a thin-film EL display panel according to the present invention. As similar to the structure of FIG. 1, a transparent electrode 2 made of $In_2O_3$, $SnO_2$ etc. is formed with a thickness of about 1400 Å. On the electrode 2, a first dielectric layer 8 is disposed with a thickness of about 2200 Å, which is preferably a double layer of an $SiO_2$ layer and an $Si_3N_4$ layer. The layer 8 is formed by sputtering or evaporation.

On the layer 8, an EL thin film 4 is formed with a thickness of about 6000 Å, by evaporating a ZnS sintered pellet doped with Mn at a preferable quantity. The Mn serves as a luminescent center in the film 4. On the film 4, a second dielectric layer 9 is provided with a thickness of about 1800 Å, which is preferably a double layer of an $Si_3N_4$ layer and an $Al_2O_3$ layer. A counter electrode 6 made of Al is evaporated thereon. Thus, the EL display panel is fabricated.

Our experiments indicated that, to improve the dielectric properties of the EL display panel, it is very preferable that the thickness of the first dielectric layer 8 be made thicker. On the contrary, thickening of the second dielectric layer 9 could scarcely improve the dielectric properties of the EL display panel.

Accordingly, while the total thickness of the first and the second dielectric layers 8 and 9 is equal to or less than the upper limit, preferably, about 4000 Å, the thickness of the first dielectric layer 8 is made thickner, preferably, about 2200 Å and the thickness of the second dielectric layer 9 is made thinner, preferably, about 1800 Å.

Our experiments confirmed that the dielectric properties of the EL display panel depend substantially on the dielectric properties of the first dielectric layer 8, which is layered on a smooth surface of its substrate, but that the dielectric properties of the EL display panel do not depend on the dielectric properties of the second dielectric layer 9, which is layered on an uneven surface of its substrate.

Therefore, as far as the dielectric properties of the first dielectric layer 8 are good, the dielectric properties of the EL display panel can be improved to prevent the generation of the dielectric breakdown.

The first dielectric layer 8 is made as thick as possible to improve the dielectric properties of the layer 8 and the second dielectric layer 9 is made as thin as possible in view of the requirement by the upper limit, so that the dielectric properties of the EL display panel are improved.

Needless to say, the second dielectric layer 9 has an appropriate thickness to provide a polarization-maintaining effect suitable for operating the EL dipslay panel.

It is preferable that the first and the second dielectric layers 8 and 9 fulfill the following relation:

$$1<d1/d2<3 \text{ and } d1+d2\approx 4000 \text{ Å}$$

where d1: the thickness of the first dielectric layer 8, d2: the thickness of the second dielectric layer 9.

While only certain embodiments of the present invention have been described, it will be apparent to those skilled in the art that various changes and modifications may be made therein without departing from the spirit and scope of the invention as claimed.

What is claimed is:

1. A thin-film electroluminescent element comprising:

a thin-film electroluminescent layer;

first and second dielectric layers surrounding the electroluminescent layer, the first dielectric layer being disposed on a smooth surface and the second dielectric layer being disposed on an uneven surface;

the thickness of the first dielectric layer being thicker than that of the second dielectric layer; and first and second electrodes provided on the dielectric layers, respectively.

2. The element of claim 1, wherein the thickness of the first and the second dielectric layers fulfills the following condition:

$$1<(d1/d2)<3$$

wherein, d1 represents the thickness of the first dielectric layer, and d2 represents the thickness of the second dielectric layer.

3. The element of claim 1, wherein the total thickness of the first and the second dielectric layers is equal to or less than about 4000 Å.

4. The element of claim 1, wherein the thickness of the first dielectric layer is about 2200 Å.

5. The element of claim 1, wherein the thickness of the second dielectric layer is about 1800 Å.

6. The element of claim 1, wherein the first electrode in contact with the first dielectric layer is disposed on a substrate for supporting the element.

7. The element of claim 1, wherein either of the first and the second dielectric layers is a double layer.

8. The element of claim 7, wherein said double layer comprises an $SiO_2$ layer and an $Si_3N_4$ layer, or an $Si_3N_4$ layer and an $Al_2O_3$ layer.

9. A thin film electroluminescent element comprising:

a thin film electroluminescent layer;

first and second dielectric layers surrounding said electroluminescent layer, said first dielectric layer being disposed on a smooth surface and said second dielectric layer being disposed on an uneven surface;

first and second electrodes provided on said dielectric layers; and the thickness of said first dielectric layer being greater than that of said second dielectric layer such that $1<(d1/d2)<3$, wherein d1 represents the thickness of said first dielectric layer and d2 represents the thickness of said second dielectric layer.

10. The element of claim 9, wherein the total thickness of the first and the second dielectric layers is equal to or less than about 4000 Å.

11. The element of claim 9, wherein the thickness of the first dielectric layer is about 2200 Å.

12. The element of claim 9, wherein the thickness of the second dielectric layer is about 1800 Å.

13. The element of claim 9, wherein the first electrode in contact with the first dielectric layer is disposed on a substrate for supporting the element.

14. The element of claim 9, wherein either of the first and the second dielectric layers is a double layer.

15. The element of claim 14, wherein said double layer comprises an $SiO_2$ layer and an $Si_3N_4$ layer, or an $Si_3N_4$ and an $Al_2O_3$ layer.

16. A thin film electroluminescent element comprising:

a first electrode having a smooth outer surface;

a first dielectric layer disposed on the smooth surface of said first electrode;

a thin-film electroluminescent layer disposed on said first dielectric layer, said thin-film electroluminescent layer having an uneven outer surface;

a second dielectric layer disposed on the uneven surface of said electroluminescent layer;

a second electrode provided on said second dielectric layer; and the thickness of said first dielectric layer being greater than that of said second dielectric layer such that $1<(d1/d2)<3$ and $d1+d2$ equals about 4000 Å, wherein d1 represents the thickness of said first dielectric layer and d2 represents the thickness of said second dielectric layer.

17. The element of claim 16, wherein d1 is about 2200 Å and d2 is about 1800 Å.

18. The element of claim 16, wherein the first electrode in contact with the first dielectric layer is disposed on a substrate for supporting the element.

19. The element of claim 16, wherein either of the first and the second dielectric layers is a double layer.

20. The element of claim 19, wherein said double layer comprises an $SiO_2$ layer and an $Si_3N_4$ layer, or an $Si_3N_4$ layer and an $Al_2O_3$ layer.

21. A thin film electroluminescent element comprising:

a thin film electroluminescent layer;

first and second dielectric layers surrounding said electroluminescent layer, said first dielectric layer being disposed on a smooth surface and said second dielectric layer being disposed on an uneven surface;

first and second electrodes provided on said dielectric layers; and the thickness of said first dielectric layer being greater than that of said second dielectric layer such that $1<(d1/d2)<3$ and $d1+d2$ equals about 4000 Å, wherein d1 represents the thickness of said first dielectric layer and d2 represents the thickness of said second dielectric layer, and such that the generation of dielectric breakdown is substantially prevented.

22. The element of claim 21, wherein d1 is about 2200 Å and d2 is about 1800 Å.

23. A thin film electroluminescent element as in claim 9, wherein (d1/d2) is at least about 1.2.

24. A thin film electroluminescent element as in claim 9, wherein (d1/d2) equals about 1.2.

25. A thin film electroluminescent element as in claim 16, wherein (d1/d2) is at least about 1.2.

26. A thin film electroluminescent element as in claim 16, wherein (d1/d2) equals about 1.2.

* * * * *